US005316126A

United States Patent [19]

Hirai

[11] Patent Number: 5,316,126

[45] Date of Patent: May 31, 1994

[54] SYSTEM FOR CONVEYING PACKAGES

[75] Inventor: Kazuyasu Hirai, Nagaokakyo, Japan

[73] Assignee: Murata Kikai Kabushiki Kaisha, Kyoto, Japan

[21] Appl. No.: 899,506

[22] Filed: Jun. 16, 1992

[30] Foreign Application Priority Data

Jun. 17, 1991 [JP] Japan ..... 3-173054

[51] Int. Cl.[5] ..... B65G 47/04

[52] U.S. Cl. ..... 198/468.6; 198/487.1; 198/803.12; 242/35.5 A

[58] Field of Search ..... 242/35.5 A; 198/487.1, 198/468.6, 803.12, 473.1, 801, 803.11

[56] References Cited

U.S. PATENT DOCUMENTS 4,515,328 5/1985 Payne, Jr. ..... 198/487.1 X
4,669,942 6/1987 Nagasawa ..... 198/803.12 X
4,721,262 1/1988 Langen ..... 242/35.5 A
4,783,021 11/1988 Nagasawa ..... 242/35.5 A X
4,796,320 1/1989 Ono ..... 242/35.5 A X
4,970,856 11/1990 Taniguchi et al. ..... 242/35.5 A X
4,988,252 1/1991 Yamamoto et al. ..... 242/35.5 A X
5,082,192 1/1992 Langen et al. ..... 242/35.5 A X
5,147,026 9/1992 Scaglia ..... 242/35.5 A X

*Primary Examiner*—D. Glenn Dayoan
*Attorney, Agent, or Firm*—Spensley Horn Jubas & Lubitz

[57] ABSTRACT

A system for conveying packages of synthetic fiber yarn in which an overhead traveling carriage including a carrier having downwardly projecting bobbin chucks is connected between a station where it receives packages of unfinished yarn from pallets, and a station where it transfers those packages to a package exchange robot in a twisting machine, and another overhead traveling carriage including a carrier having horizontally projecting peg shafts is connected between a station where it receives packages of processed yarns from a rotary peg in the twisting machine, and a station where it delivers those packages to a rotary stocker.

5 Claims, 16 Drawing Sheets

SYSTEM FOR CONVEYING PACKAGES

BACKGROUND OF THE INVENTION

1. Field of the Invention

This invention relates to the automation of a twisting plant for producing synthetic fiber yarn, and more particularly, to a system for conveying packages of synthetic fiber yarn to convey them to and from a twisting machine.

2. Prior Art

Reference is first made to FIG. 10 illustrating the basic flow of synthetic fiber yarn in a twisting plant. A twisting machine 101 twists raw yarns or unfinished yarns to form packages of processed yarns. "Full" means full packages of unfinished yarns or processed yarns, and "empty" means take-up tubes. Packages of unfinished yarns are packed in boxes, and the boxes are conveyed on pallets from a raw yarn plant to an unpacking device 102 by which they are opened, and the packages are conveyed to a package exchange robot 104 by a package conveying apparatus 103. The packages are transferred from the package exchange robot 104 to the desired positions in the twisting machine 101. The take-up tubes left empty after processing are conveyed to a receptacle 105 for empty take-up tubes by the package exchange robot 104 and the package conveying apparatus 103. The packages of processed yarns leaving the twisting machine are doffed by an automatic doffer 106, and conveyed to a stocker 108 by a yarn conveying apparatus 107. They are inspected at 109 and packed at 110 for shipment. Although the twisting machine 101 is operated on a 24-hour-a-day basis, the inspection 109 and the packing 110 are usually performed on an 8-hour-a-day basis, and the stocker 108 is, therefore, provided as an accumulator therebetween. Take-up tubes are supplied from a take-up tube supplying apparatus 111 to the twisting machine 101 through the yarn conveying apparatus 107 and the automatic doffer 106.

The package conveying apparatus 103 and yarn conveying apparatus 107 which are employed have a critical bearing on the efficiency of such a flow in a limited space. It is usual to employ a tray conveyor, a pin truck, or an overhead conveyor. The arrangement of machines and apparatuses in a twisting plant in which an overhead conveyor is employed will be described with reference to FIG. 11. The overhead conveyor is shown at 120 in FIG. 11, and serves as both the unfinished yarn and processed yarn conveying apparatuses, and the machines and apparatuses are arranged along it. They are twisting machines 1A to 1N, creels 2, package exchange robots 4 associated with the creels 2, rotary pegs 5, automatic doffers 6 associated with the rotary pegs 5, a tray stocker 121, an inspection apparatus 7 provided along a tray conveyor, a packing apparatus 8, an apparatus 9 for collecting empty take-up tubes, an apparatus 10 for supplying take-up tubes, and an unpacking apparatus 11.

Description will be made with reference to FIG. 12 of a station A for delivering packages from the unpacking apparatus 11 to the overhead conveyor 120. Packages P of unfinished yarns are transferred from unpacked pallets 12 to a lift 123 by a transfer robot 122, and from the lift 123 to hangers 120*a* attached to the overhead conveyor 120. The hangers 120*a* which have received packages P are turned by 180° by turning cams 120*b*.

Description will now be made with reference to FIG. 13 of a station B for transferring packages P from the overhead conveyor 120 to the package exchange robot 4. The package P is transferred from the hanger 120*a* to an arm 124*a* on a lift 124, and the arm 124*a* is lowered and turned by 90° so as to face the robot 4. The robot 4 travels and receives the package P.

Description will now be made with reference to FIGS. 14(*a, b*)of a station C for delivering packages of processed yarns from the rotary peg 5 of a twisting machine to the overhead conveyor 120. Packages P of processed yarns are transferred one by one from the rotary peg 5 to an arm 125*a* on a lift 125, and the arm 125*a* is raised and turned by 90° to deliver the packages P one by one to the hangers 120*a*.

Description will now be made with reference to FIG. 15 of a station D for delivering packages P of processed yarns from the overhead conveyor 120 to the tray stocker 121. The package P is transferred from each hanger 120*a* to a lift 126 and its arm 126*a* is lowered. A transfer robot 127 receives the package P from the arm 126*a*, and puts it in a tray 13 on the conveyor 121*a* leading to the tray stocker.

The system for conveying packages of synthetic fiber yarn by employing an overhead conveyor as hereinabove described is designed for conveying packages one by one to and from the twisting machines, and has, therefore, the drawback of having only a limited capacity and being suitable for use with only a limited number of twisting machines. Although a pin truck may be useful for conveying a large number of packages at a time, a sufficiently large floor space is required for an operatorless carriage to travel to move the pin truck, and moreover, the transfer of packages to and from the pin truck produces a great burden. A tray conveyor can diminish such burden, but requires a large floor space for installation.

OBJECT AND SUMMARY OF THE INVENTION

It is an object of this invention to provide a system for conveying packages of synthetic fiber yarn which has a large conveying capacity and yet enables the effective use of a limited space.

The above object is attained by a system for conveying packages of synthetic fiber yarn wherein a station for delivering packages of unfinished yarns from pallets and a station for transferring the packages to a package exchange robot in a twisting machine are connected to each other by an overhead traveling carriage including a carrier having downwardly projecting bobbin chucks, while a station for receiving packages of processed yarns from a rotary peg in the twisting machine and a station for delivering the packages of processed yarns to a rotary stocker are connected to each other by an overhead traveling carriage including a carrier having horizontally projecting peg shafts.

The system has a higher conveying capacity if the carrier of either of the overhead traveling carriages has a larger number of bobbin chucks or peg shafts. The downwardly projecting bobbin chucks deliver packages of finished yarns directly from the pallets to the robot, and the horizontally projecting peg shafts receive packages of twisted yarns directly from the rotary peg.

DETAILED DESCRIPTION OF PREFERRED EMBODIMENT

Figure 1:
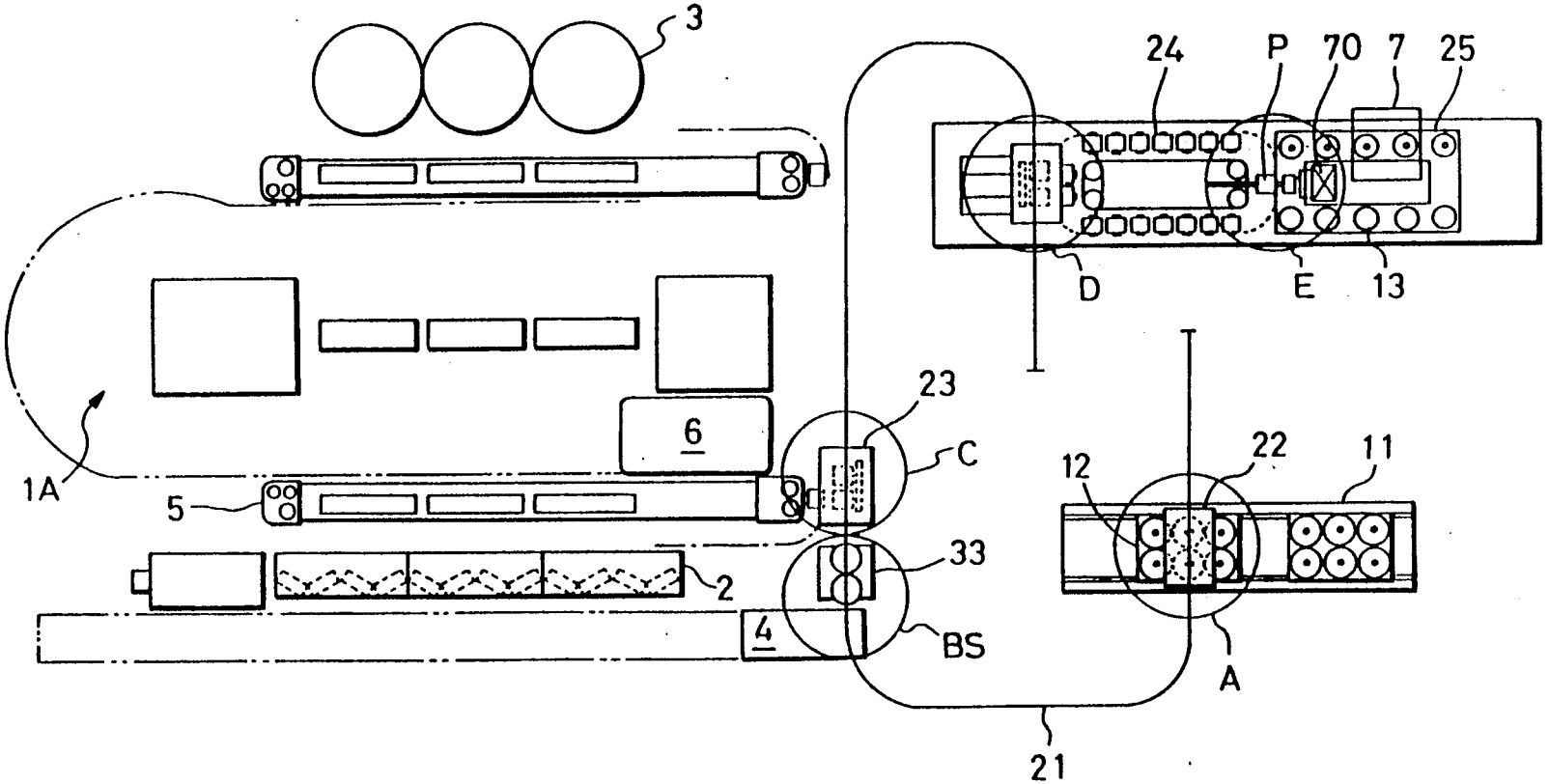
FIG. 1 is a diagram showing the layout of the system for conveying packages of synthetic fiber yarn which embodies this invention.

Description will now be made of an embodiment of this invention with reference to drawings. FIG. 1 is a diagram showing the layout of a system for conveying packages of synthetic fiber yarn embodying this invention.

In FIG. 1, 21 is a rail for an overhead traveling carriage 22 for conveying packages of unfinished yarns and an overhead traveling carriage 23 for conveying packages of processed yarns, and various apparatuses are installed along the rail 21. The layout is shown in a simplified way to show the basic features of the system. A twisting machine is shown at 1A, creels at 2 and 3, a package exchange robot for the creels at 4, a rotary peg at 5, and an automatic doffer for the rotary peg 5 at 6. A rotary stocker is shown at 24, an inspection apparatus 7 is situated along a tray conveyor 25, and an unpacking apparatus is shown at 11. The system further includes a packing apparatus, an apparatus for collecting empty take-up tubes and an apparatus for supplying take-up tubes, though they are not shown.

Figure 2:
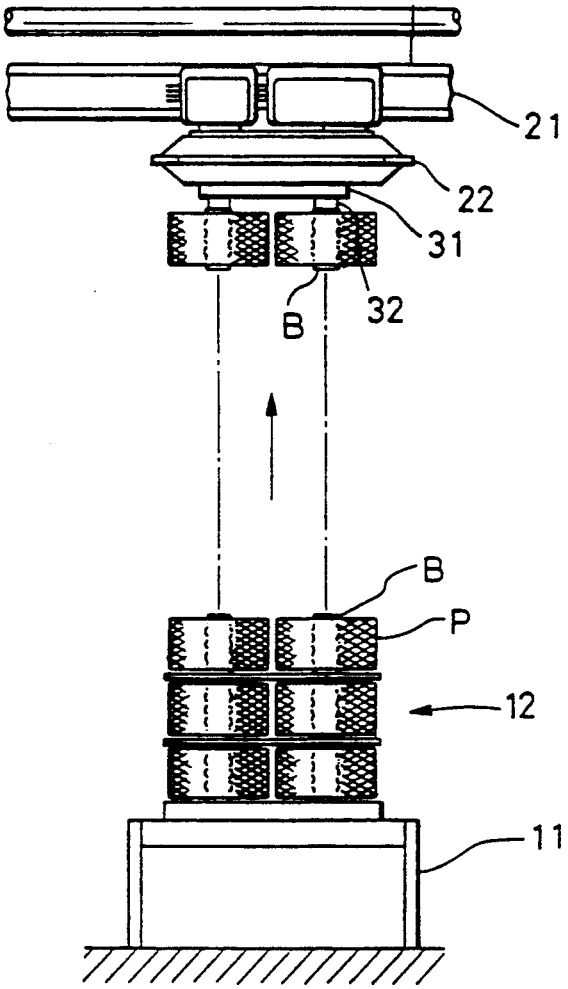
FIG. 2 is a side elevational view of the station where packages are delivered from the unpacking apparatus to the overhead traveling carriage.

Description will be made with reference to FIGS. 1 and 2 of a station A where packages are delivered from the unpacking apparatus 11 to the overhead traveling carriage 22. As shown in FIG. 1, the overhead traveling carriage 22 can be stopped immediately above a pallet 12 which is movable horizontally of the drawing, while keeping a fixed distance from another pallet 12. The unpacking apparatus 11 not shown removes the top cover, etc. of the pallet 12 to expose packages P of unfinished yarns mounted thereon with bobbins B positioned vertically, as shown in FIG. 2. The overhead traveling carriage 22 is provided with a carrier 31 suspended therefrom vertically movably by a lifting belt, and having two downwardly projecting bobbin chucks 32. Each bobbin chuck 32 has a rubber pad which is capable of expanding or contracting along the inside diameter of a bobbin. B. After the bobbin chucks 32 have been contracted, the carrier 31 is lowered, and the bobbin chucks 32 are inserted into the bobbins B of packages P on the pallet 12. The bobbin chucks 32 are expanded and the carrier 31 is raised to lift the packages, as shown. Then, the overhead traveling carriage 22 is caused to travel to a transfer station BS.

Description will now be made with reference to FIGS. 1 to 4 of the transfer station BS where packages are transferred from the overhead traveling carrriage 22 to the package exchange robot 4. A swinging platform 33 is installed in line with the creels 2 and faces the package exchange robot 4, as shown in FIG. 1. The overhead traveling carriage 22 is stopped immediately above the swinging platform 33. The construction and operation of the swinging platform 33 will be described with reference to FIG. 4. A table 35 is secured to a rotatably supported shaft 34. The table 35 has two upwardly projecting peg shafts 36. An arm 37 is secured to the shaft 34, and a cylinder 39 is connected between the free end of the arm 37 and a base 38. 38*a* is a carrier positioning guide rod. When the cylinder 39 is in its retracted position as shown, the table 35 lies in a horizontal plane and the peg shafts 36, therefore, extend vertically. If the cylinder 39 is extended to move the arm 37 to its position shown by a two-dot chain line, the table 35 lies in a vertical plane and the peg shafts 36 extend horizontally. The operation of the swinging platform 33 will be explained with reference to FIG. 3. If the overhead traveling carriage 22 lowers its carrier 31, the carrier 31 is so positioned by the guide rod 38*a* as to position packages P of unfinished yarns immediately above the table 35. If the bobbin chucks 32 are contracted, the packages P are inserted over the upwardly directed peg shafts 36. After the carrier 31 has been raised, the cylinder 39 is extended to rotate the table 35 counterclockwise by 90° about the shaft 34, so that the packages P may face horizontally, as shown by two-dot chain lines. Then, the packages P are received by the package exchange robot 4 one after another.

Figure 3:
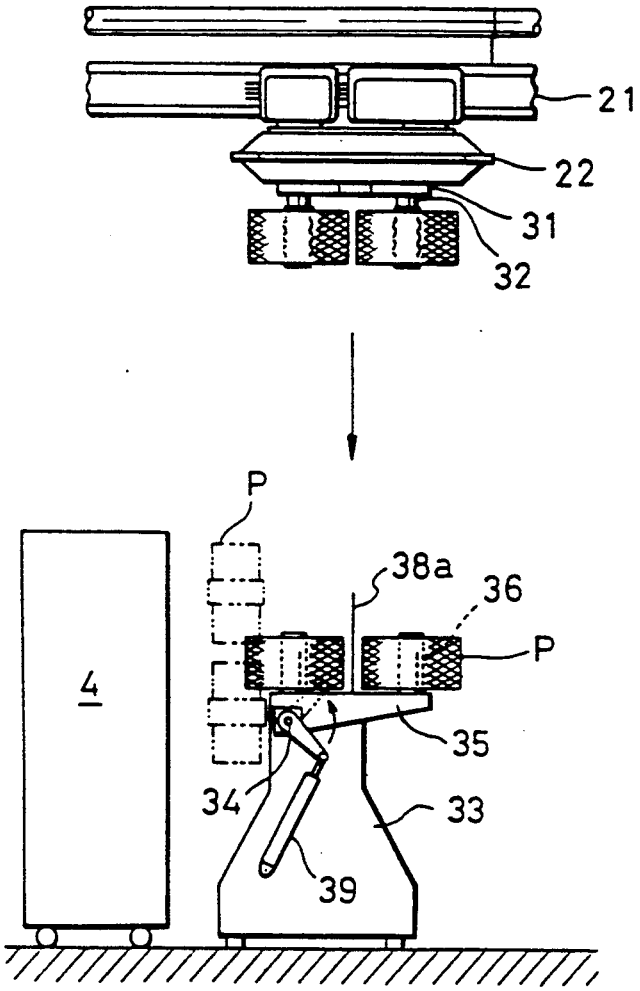
FIG. 3 is a side elevational view of the station where packages are transferred from the overhead traveling carriage to the package exchange robot.
Figure 4:
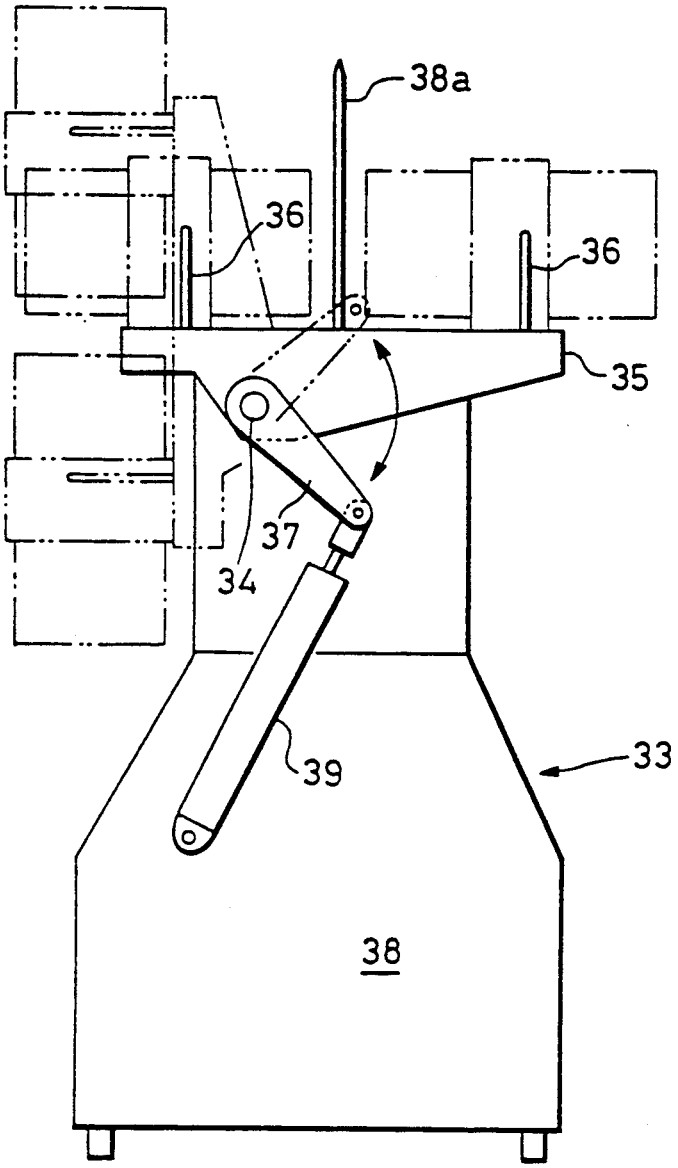
FIG. 4 is a side elevational view of the swinging platform.
Figure 12:
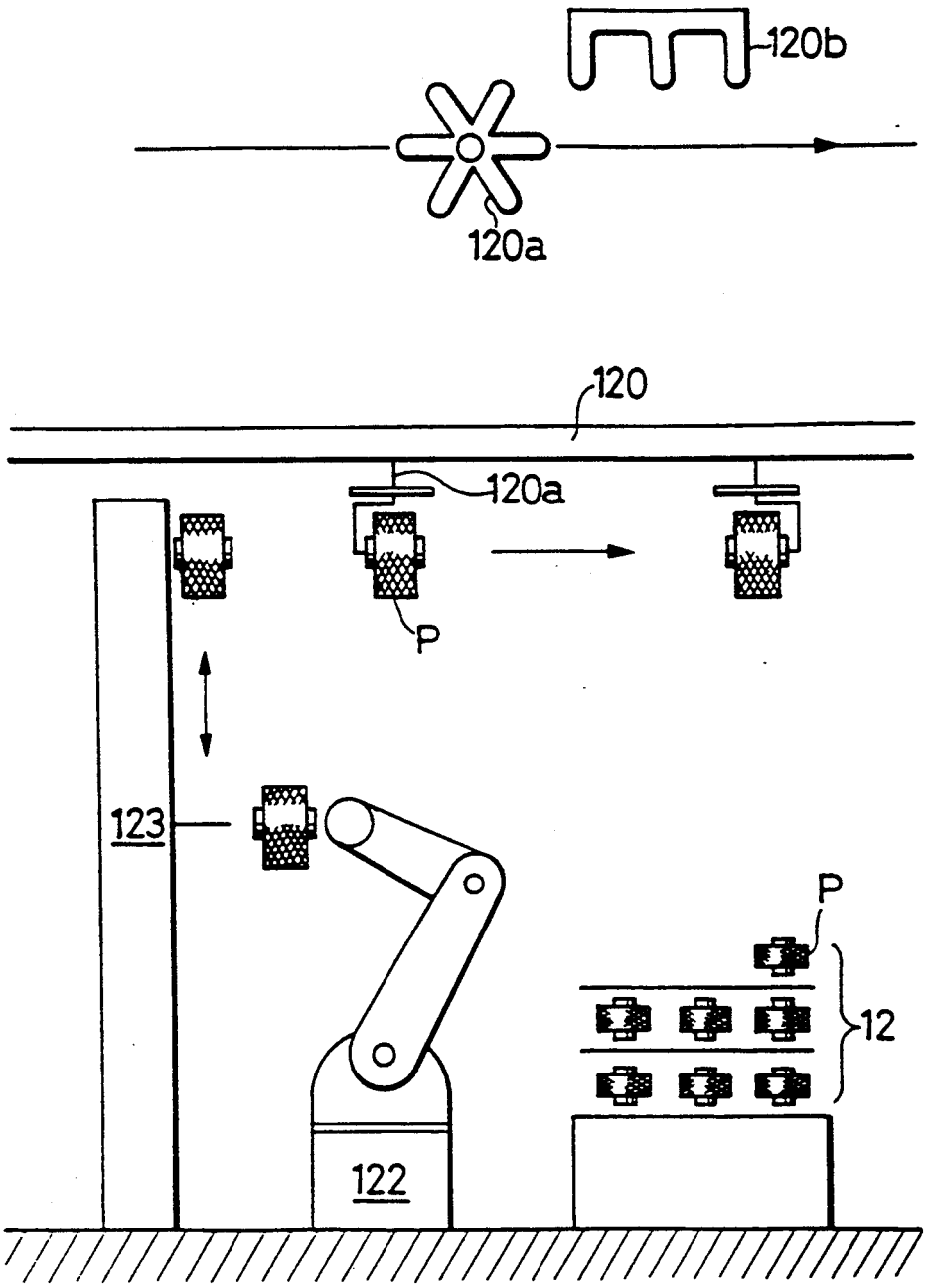
FIG. 12 PRIOR ART
FIG. 12 is a view of the station where packages are delivered from the unpacking apparatus to the overhead conveyor.
Figure 13:
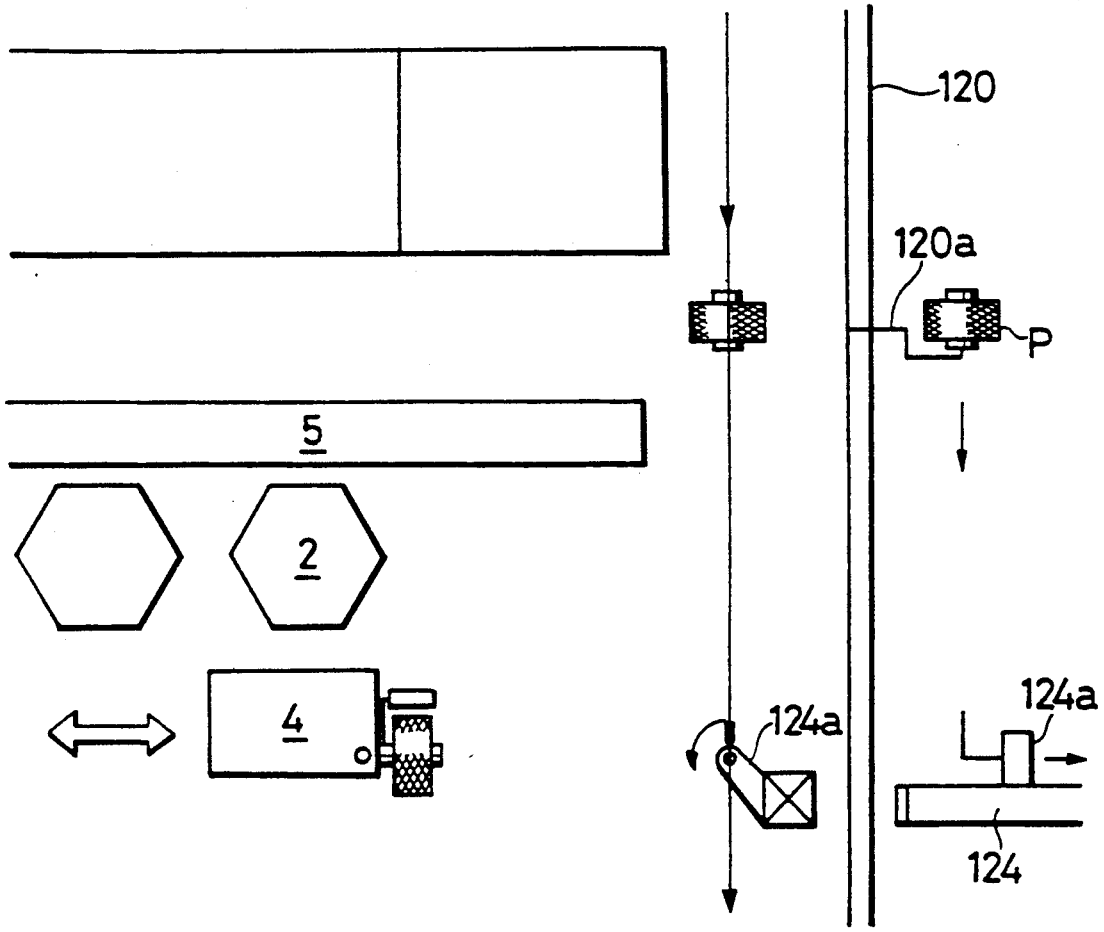
FIG. 13 PRIOR ART
FIG. 13 is a view of the station where packages are transferred from the overhead conveyor to the package exchange robot.
Figure 14A:
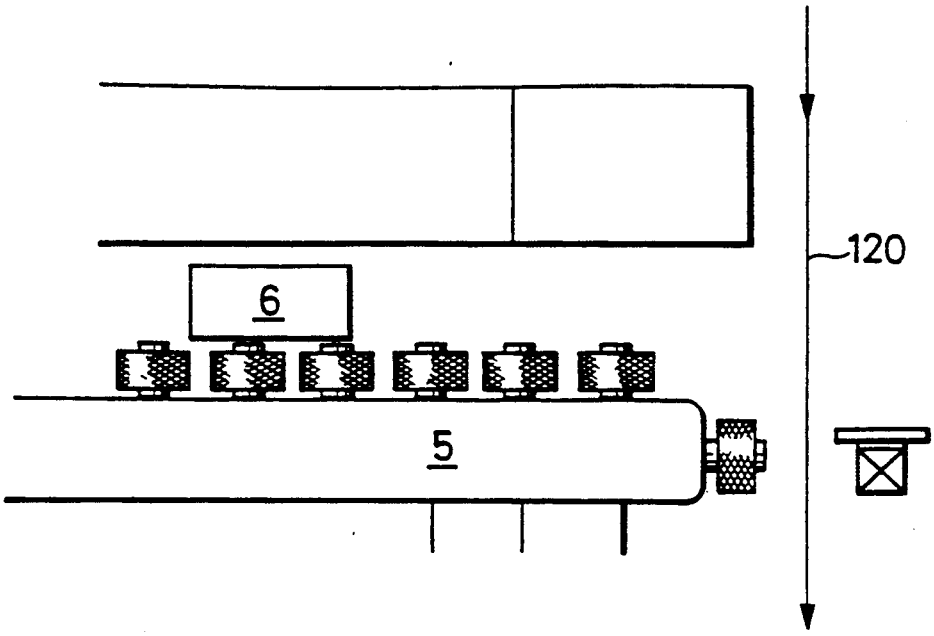
FIG. 14A PRIOR ART
FIG. 14*a* and FIG. 14*b* are views showing the transfer of packages from the rotary peg to the overhead conveyor.
Figure 14B:
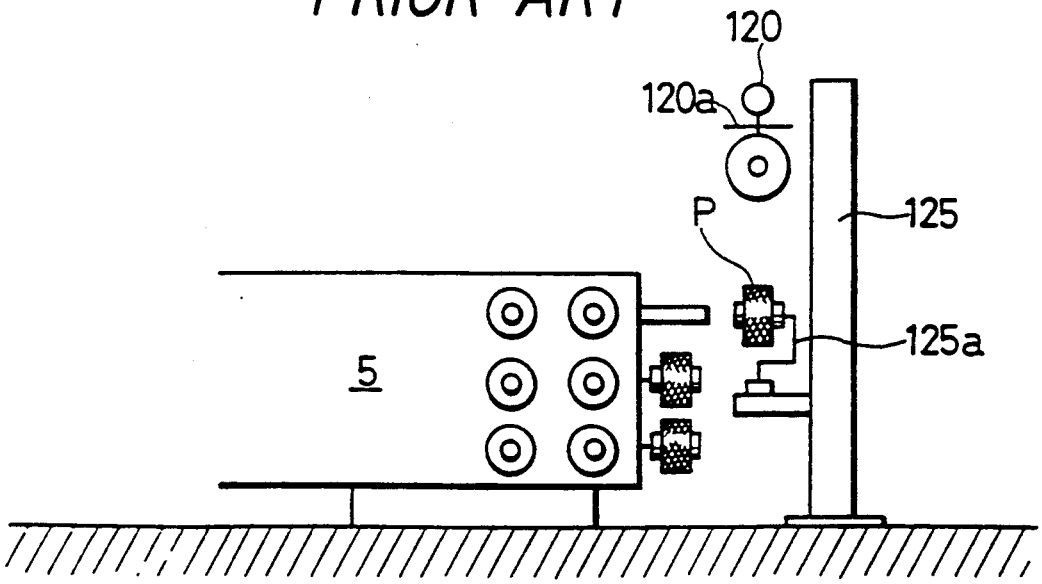
FIG. 14B PRIOR ART

That number of packages P which is equal to the number of the bobbin chucks 32 (two as shown by way of example) projecting from the carrier 31 of the overhead traveling carriage 22 can be conveyed at a time from the delivery station A shown in FIG. 2 to the transfer station BS shown in FIG. 3. The delivery station A enables the direct delivery of packages P from the pallet 12 to the bobbin chucks 32, and the omission of the transfer robot and the lift from the system as shown in FIG. 12 and thereby the saving of the space thereby occupied. The transfer station BS shown in FIG. 3 relies solely upon the swinging platform 33 having the same number of peg shafts with the bobbin chucks 32 for the successive transfer of a plurality of packages P to the package exchange robot 4. The robot 4 has a simplified hand motion, since the transfers of packages between the swinging platform 33 and the robot 4 and between the robot 4 and the creels 2 take place in the same direction, as shown in FIG. 1.

Figure 5:
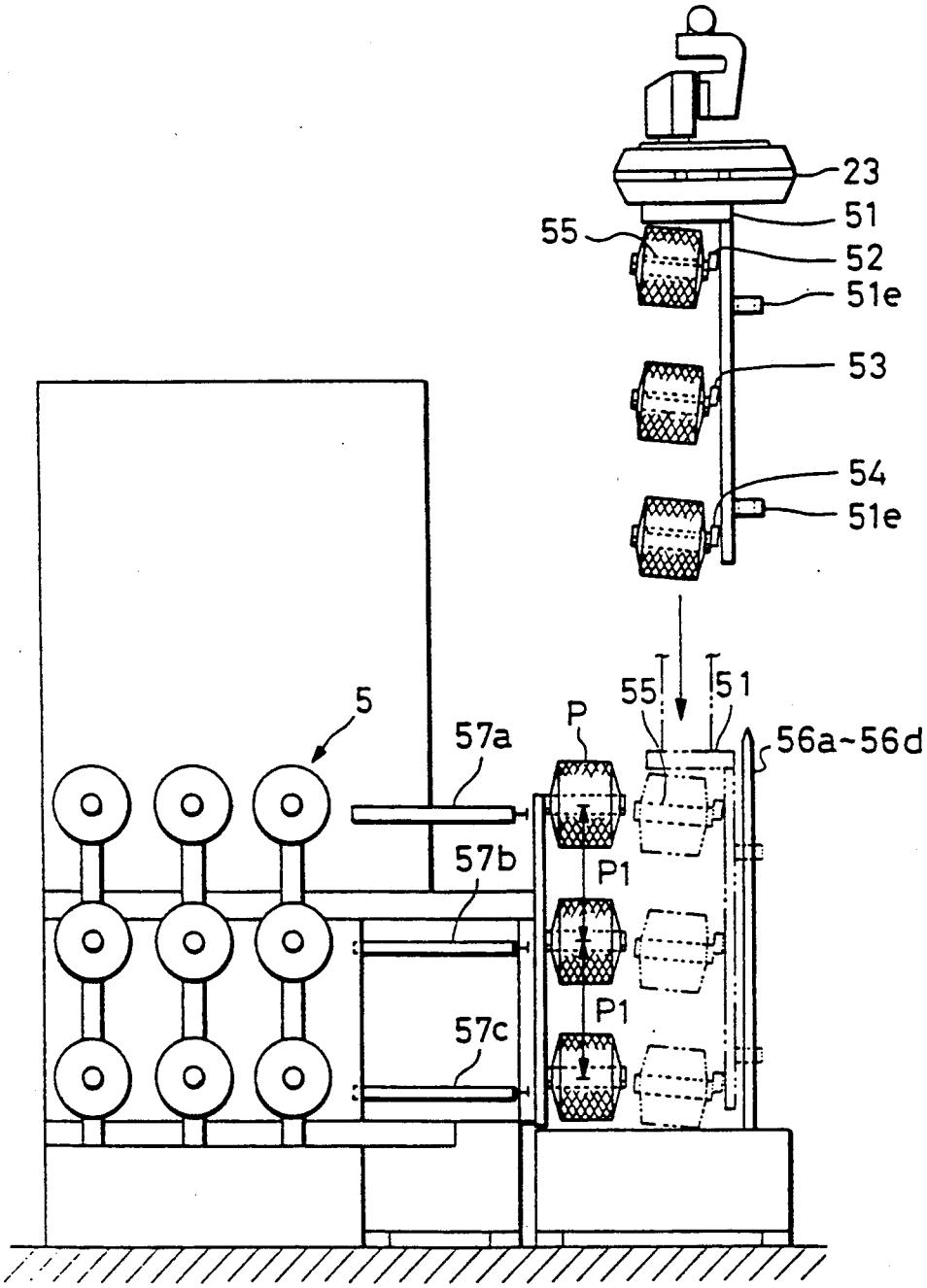
FIG. 5 is a side elevational view of the station where the overhead traveling carriage receives packages from the rotary peg.
Figure 6:
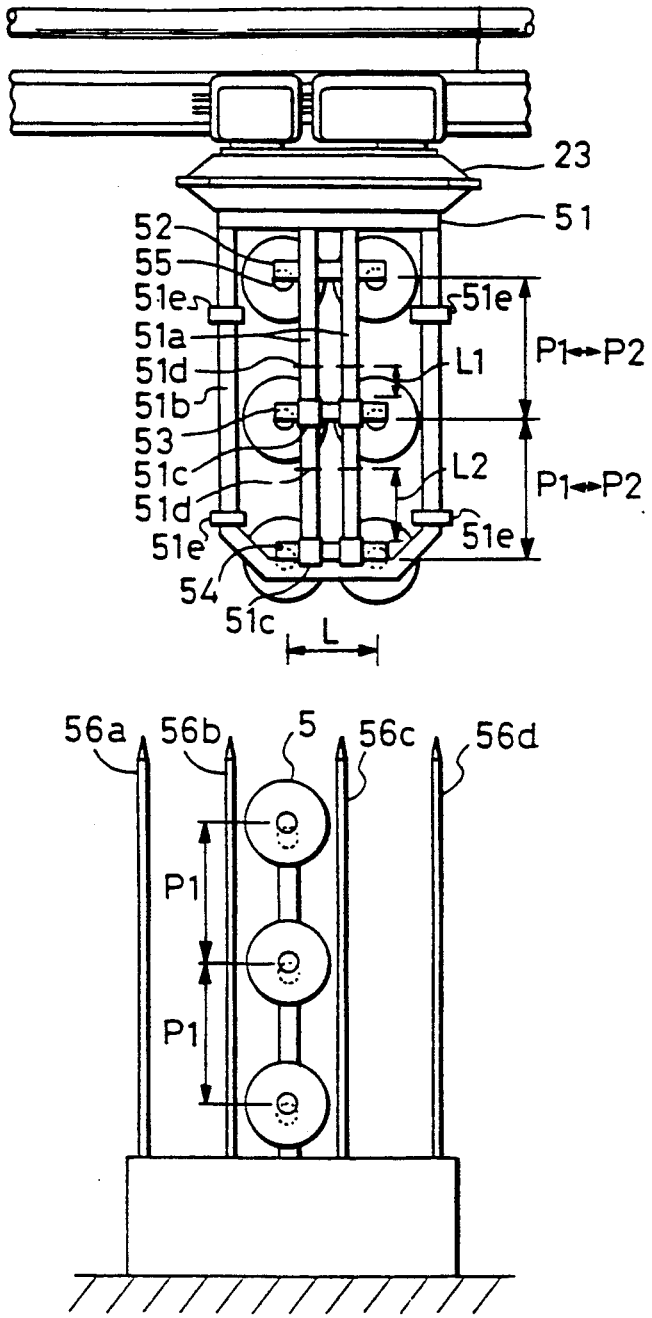
FIG. 6 is a front elevational view of the station where the overhead traveling carriage receives packages from the rotary peg.

Description will now be made with reference to FIGS. 1, 5 and 6 of a receiving station C in which the overhead traveling carriage receives packages from the rotary peg. The overhead traveling carriage 23 is stopped immediately above the end of the rotary peg 5, as shown in FIG. 1. The package of finished yarn are transferred to the rotary pegs 5 from the twisting machine 1A through the automatic doffer 6. As conventionally known, packages arranged in plural rows and by three in vertical direction are wound up in the twisting machine 1A. The three packages in the same row are simultaneously doffed by the automatic doffer 6 by the same pitch and same arrangement as those of wound-up packages in the twisting machine, and then they are transferred on the rotary pegs 5. Accordingly, the pitch P1 between the rotary pegs 5 shown in FIG. 5 is equal to the pitch between each of the three packages arranged in the vertical direction in the twisting machine 1A. A carrier 51 comprising an inverted L-shaped framework as viewed in side elevation is suspended from the overhead traveling carriage 23 vertically movably by a lifting belt, as shown in FIG. 5. The carrier 51 includes a central frame 51*a* having an upper portion to which a first horizontal plate 52 is secured, a middle portion on which a second horizontal plate 53 is vertically slidably fitted, and a lower portion on which a third horizontal plate 54 is vertically slidably fitted, as shown in FIG. 6. Each of the horizontal plates 52 to 54 has a horizontally projecting peg shaft 55 on either side thereof, and the carriage can, therefore, convey a total of six packages P of processed yarns at a time, as shown. The central frame 51*a* has an upper-limit stopper 51*c* and a lower-limit stopper 51*d* for the second and third horizontal frames 53 and 54, so that the second horizontal frame 53 may be slidable over a distance $L_1$, while the third horizontal frame 54 is slidable over a distance $L_2$. As a consequence, the peg shafts 55 have a pitch which is variable between a large pitch $P_1$ and a small pitch $P_2$. An outer frame 51*b* has guide hole members 51*e*, and the mutually facing portions of the rotary peg 5 have a total of four guide rods 56*a* to 56*d*. If the guide hole members 51*e* of the outer frame 51*b* are guided to the guide rods 56*b* and 56*d*, the peg shafts 55 shown on the left-hand side of the drawing face the rotary peg 5, and if the guide hole members 51*e* are guided to the guide rods 56*a* and 56*c*, the peg shafts 55 on the right-hand side face the rotary peg 5. The rotary peg 5 is provided at its end with pushers 57*a* to 57*c* for pushing out packages P toward the peg shafts 55 on the carrier 51, as shown in FIG. 5.

The operation of the receiving station C as hereinabove described will be explained with reference to FIGS. 5 and 6. The overhead traveling carriage 23 lowers its carrier as shown, and receives a total of three packages of processed yarns on the left peg shafts 55. After it has been raised, the carriage 23 is laterally moved by a distance L, and the carriage 51 is lowered again to receive a total of three packages of processed yarns on the right peg shafts 55. Accordingly, the carriage can receive and covey six packages of processed yarns at a time. As the vertically spaced apart peg shafts 55 have a pitch which is variable from $P_1$ to $P_2$, the carriage can transfer packages of processed yarns from the rotary peg 5 having a long pitch $P_1$ to the peg shafts of the rotary stocker having a short pitch $P_2$ efficiently in a single operation, as will hereinafter be described.

Figure 7A:
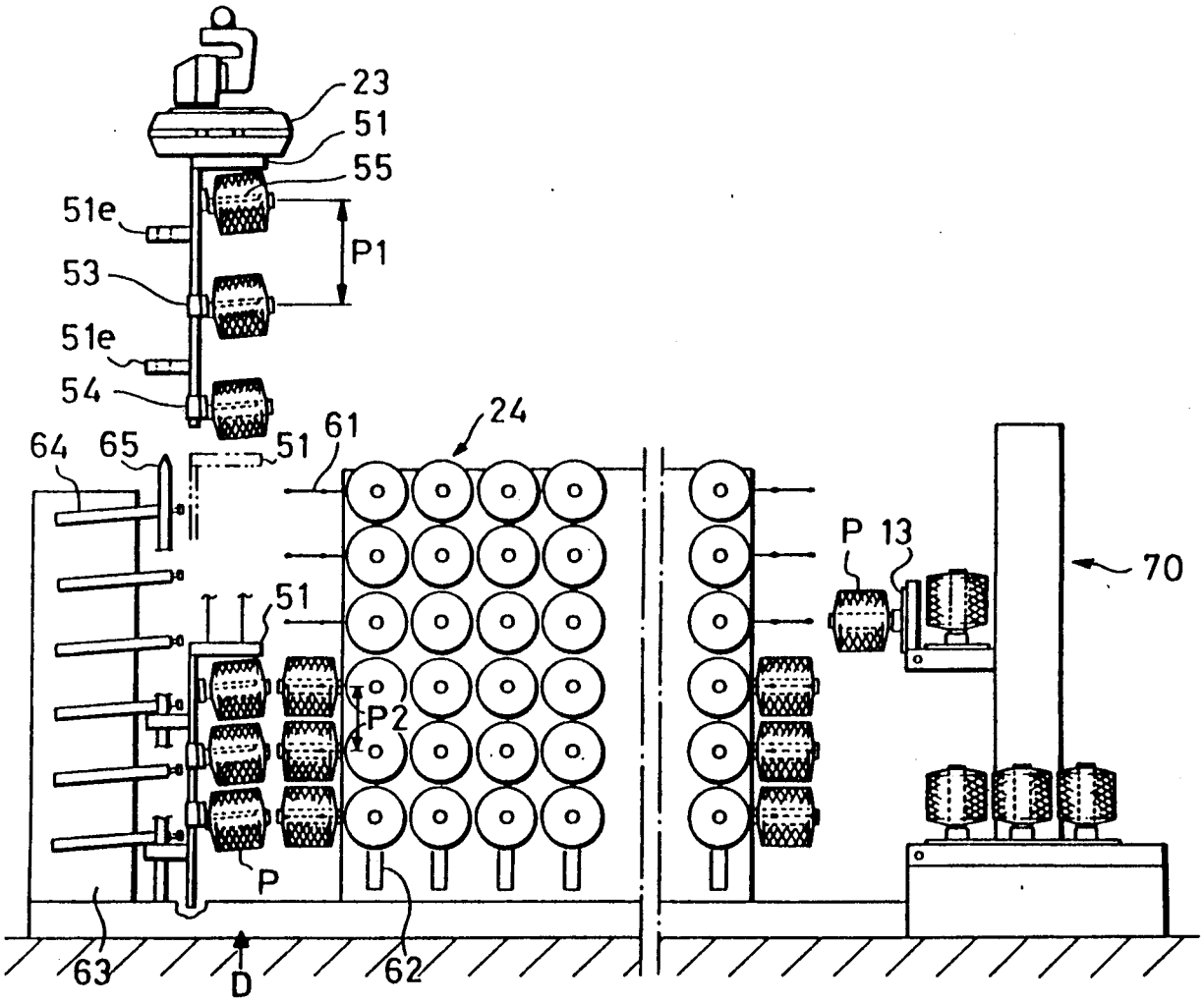
FIG. 7*a* is a side elevational view of the station where packages are delivered to the rotary stocker, and the station where packages are delivered from the rotary stocker.

Description will now be made with reference to FIGS. 1 and 7 of a supply station D in which packages are delivered from the overhead traveling carriage to the rotary stocker. The overhead traveling carriage 23 is stopped immediately above the end of the rotary stocker 24, as shown in FIG. 1. The rotary stocker 24 comprises vertical plates 62 each having six vertically spaced apart and horizontally projecting peg shafts, as shown in FIG. 7, and the vertical plates 62 form an oval array as viewed in top plan, and are connected to e.g. a drive chain not shown so as to be capable of making a controlled circulating motion together. Two peg shafts are located at the left end of the rotary stocker 24 as viewed in FIG. 1, and one peg shaft at the right end thereof. Referring to FIG. 7 again, a delivery apparatus 63 faces the left end of the rotary stocker 24 and a transfer apparatus 70 faces the right end thereof, as will hereinafter be described. The delivery apparatus 63 includes a total of 12 pushers 64 consisting of two rows of six pushers each, two guide rods 65 spaced apart from each other as viewed across the thickness of the drawing sheet, and positioning members, not shown, for the horizontal plates 53 and 54. When the carrier 51 is lowered, the guide hole members 51*e* are guided by the guide rods 65, and when the carrier 51 has been lowered to its lowermost position as shown, the horizontal plates 53 and 54 are held against downward movement by the positioning members not shown, so that the peg shafts of the carrier may have a pitch $P_2$ instead of $P_1$ and be aligned with the lower three sets of peg shafts 61 of the rotary stocker 24, and six packages P of processed yarns are delivered to the rotary stocker 24 at a time by the pushers 64. When the carrier 51 is lowered to its halfway position as shown by a two-dot chain line, the horizontal plates 53 and 54 are held against downward movement by the positioning members not shown, so that the peg shafts of the carrier may have their pitch changed from $P_1$ to $P_2$ and be aligned with the upper three sets of peg shafts 61 of the rotary stocker 24, and six packages P of processed yarns are delivered to the rotary stocker 24 at a time by the pushers 64.

The rotary stocker 24 occupies a small floor space for its installation and yet can stock a multiplicity of packages of processed yarns, as its height is effectively used for stocking those packages in a multiplicity of rows lying vertically side by side and each consisting of six vertically spaced apart packages held close to one another. The packages P of processed yarns arriving from the twisting machine operating on a 24-hour-a-day basis are delivered to the rotary stocker 24 through the delivery apparatus 63 efficiently to make a dense stock, and the packages P to be inspected are transferred from the rotary stocker 24 to the trays 13 by the transfer apparatus 70 for successive transfer to the inspecting apparatus operating on an 8-hour-a-day basis.

Furthermore, between the receiving station C and the supply station D, three packages which are arranged on the rotary pegs 5 as same arrangement as in the twisting machine 1A are transferred to the rotary stocker 24 through the overhead traveling carriage 23 maintaining the same arrangement of the three packages as on the rotary pegs. Thus, the package stored in the rotary stocker 24 can be known on which spindle of anyone of the twisting machine the package is finished even if numerals are not indicated on packages P. So, when a defective package is found out in the next inspecting process, it can be easily known on which spindle of anyone of the twisting machine subjective defective package has been finished.

Figure 7B:
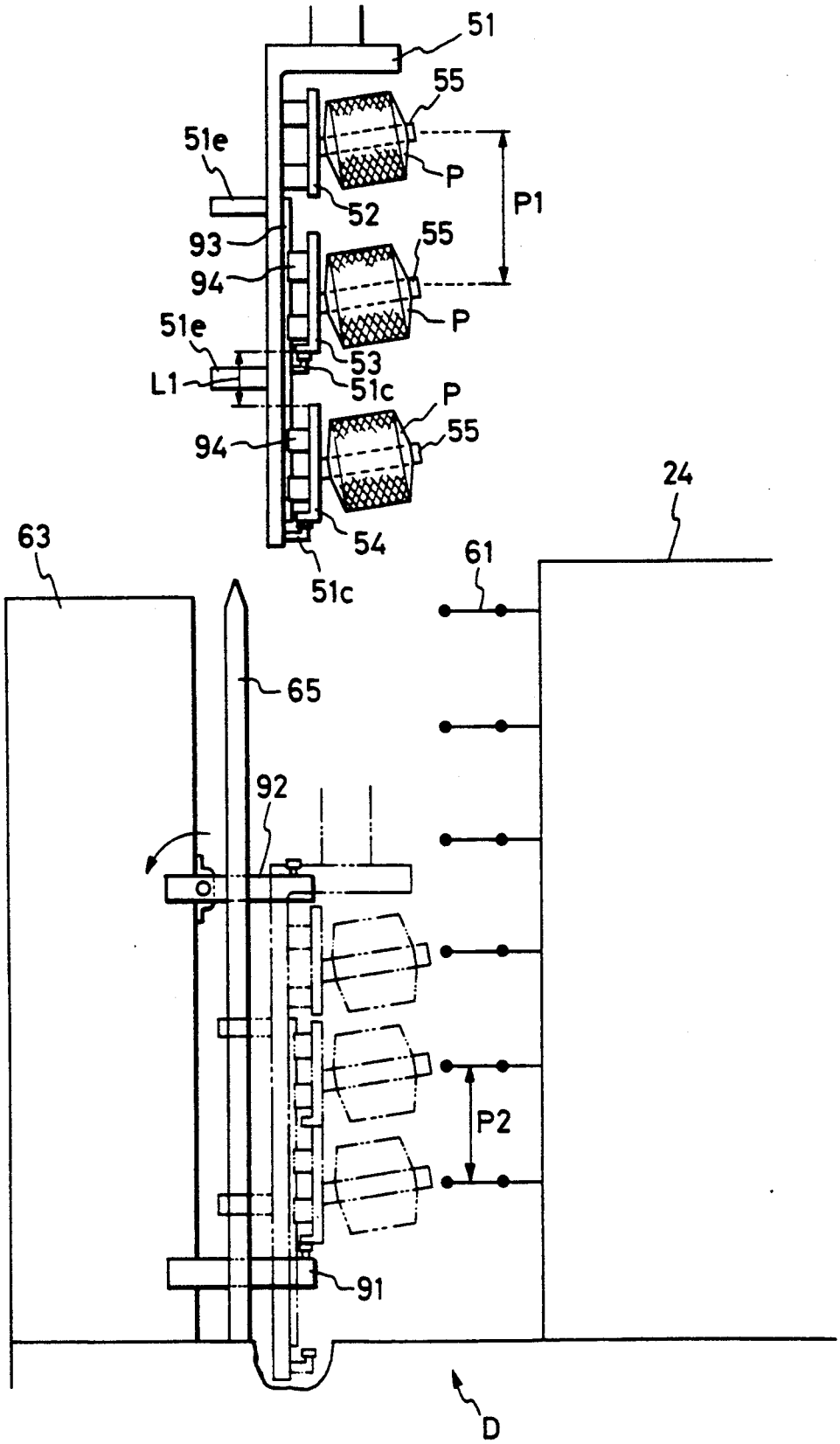
FIG. 7*b* is a side elevational view showing another embodiment of a carrier of the overhead traveling carriage and the station.

FIG. 7*b* shows another embodiment of the carrier 51 of the overhead traveling carriage 23 and the supply station D. The carrier 51 of this embodiment does not provide the upper limit stopper 51*d*. When the third horizontal plate 54 is slided by a distance L1, the upper end of the third horizontal plate 54 comes to be contacted with the lower end of the second horizontal plate 53. The pitch between the peg shaft 55 of the second horizontal plate 53 and the peg shaft 55 of the third horizontal plate 54 contacted with the second horizontal plate 53 is P2. In FIG. 7*b*, 93 designates a slide rail and 94 designates a slide bearing. A stationary positioning member 91 and a movable positioning member 92, which is turned by an actuator not shown, are provided at the supply station D. The positioning member 92 is located at the operating position shown in the drawing when the packages P are transferred onto the three peg shafts 61 from the upper end of the rotary stocker 24. While, the positioning member 92 is turned as shown by an arrow to be retracted to the unoperative position when the packages P are transferred onto the three peg shafts 61 from the lower end of the rotary stocker 24 so that the positioning member 92 does not prevent from passage of the horizontal frames 52, 53 and 54 of the carrier 51. The positioning members 91 and 92 are located to be deviated from the lower limit stopper 51C in the horizontal direction so that they are not influenced with each other.

If the carrier 51 is lowered from the position shown in FIG. 7*b* by a solid line to transfer the package P onto the three peg shaft 61 from the lower end, the lower end of the third horizontal plate 54 comes into contact with the positioning member 91, the third horizontal plate 54 is slided by a distance L1, and the upper end of the third horizontal plate 54 comes to contact with the lower end of the second horizontal plate. If the carrier 51 is further lowered, the third horizontal plate 54 is slided by a distance L1 and the second horizontal plate 53 is slided by a distance L1 at the same time. As a result, the pitch between each peg shaft 55 becomes to be P2 and the lower three peg shafts 61 of the rotary stocker 24 confront with each peg shaft 55.

Figure 8:
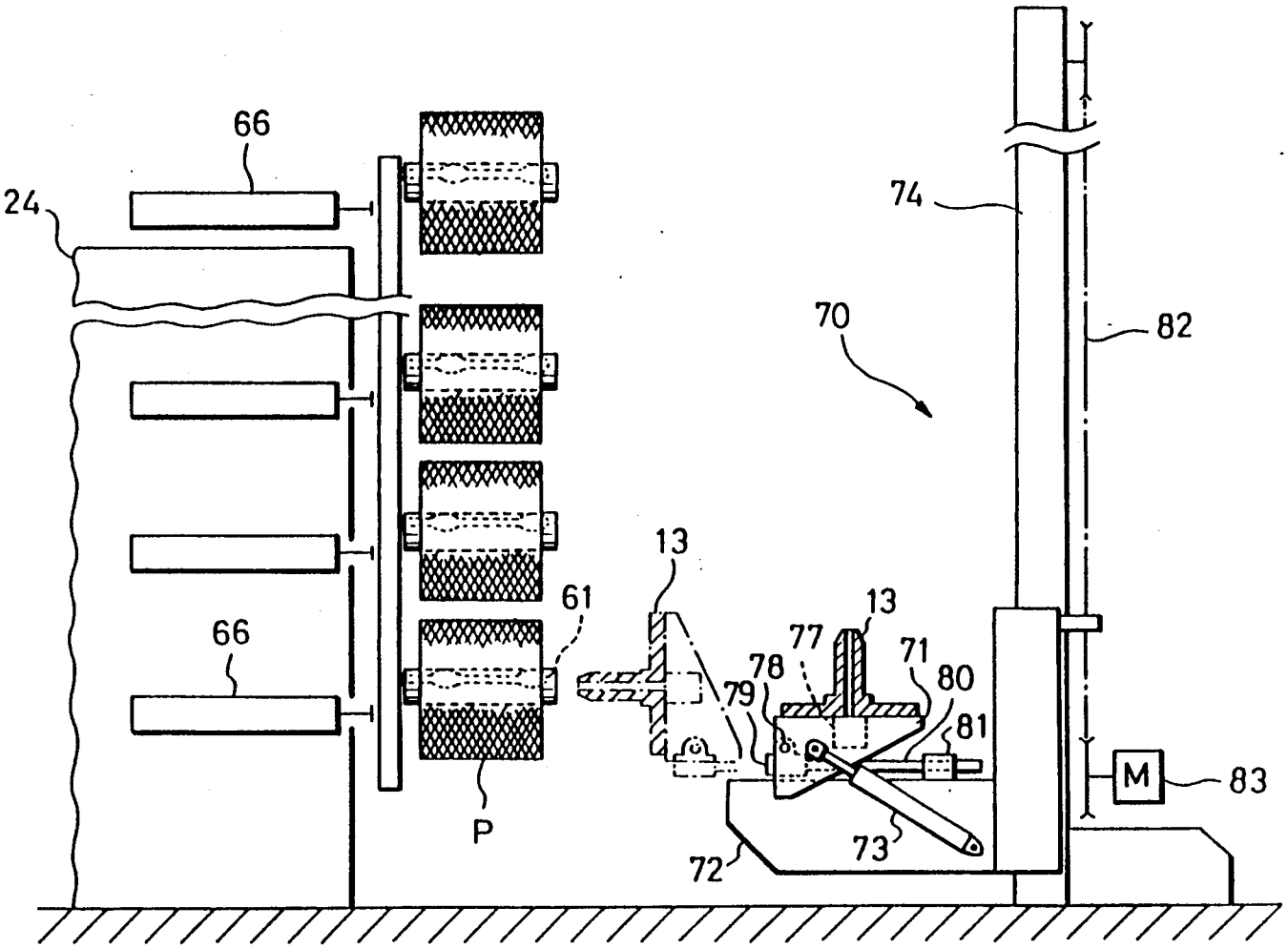
FIG. 8 is a side elevational view of the transfer apparatus.
Figure 9:
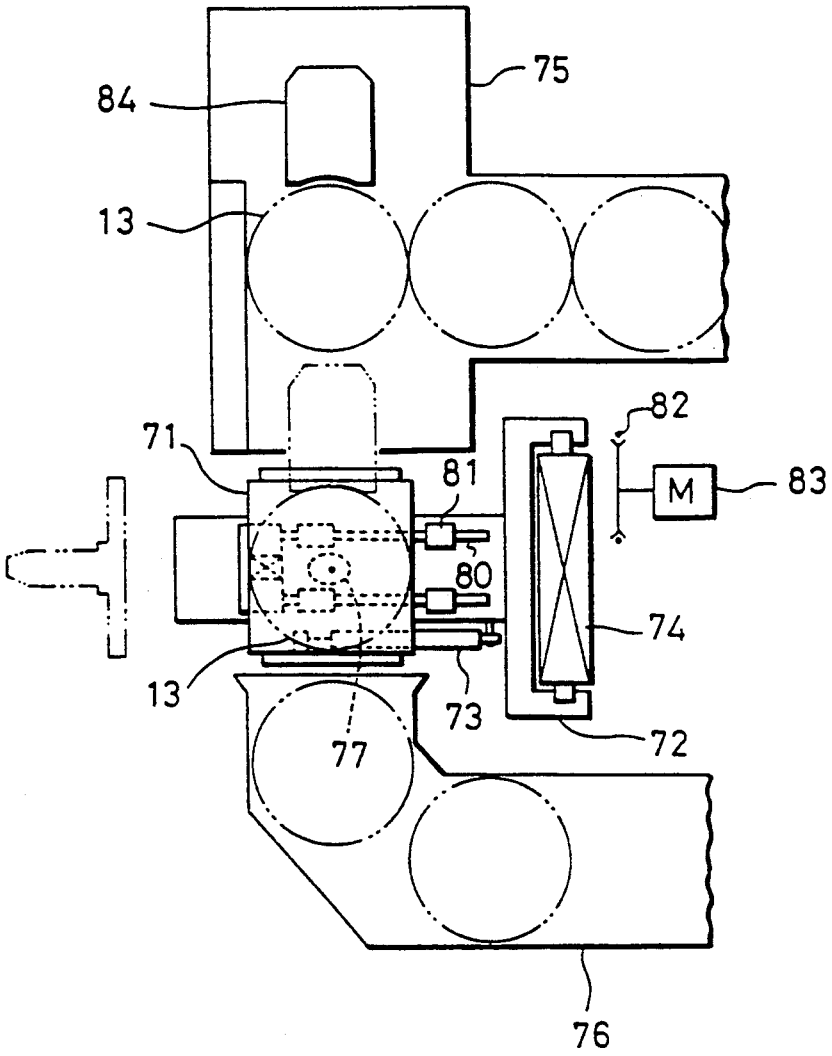
FIG. 9 is a top plan view of the transfer apparatus.
Figure 10:
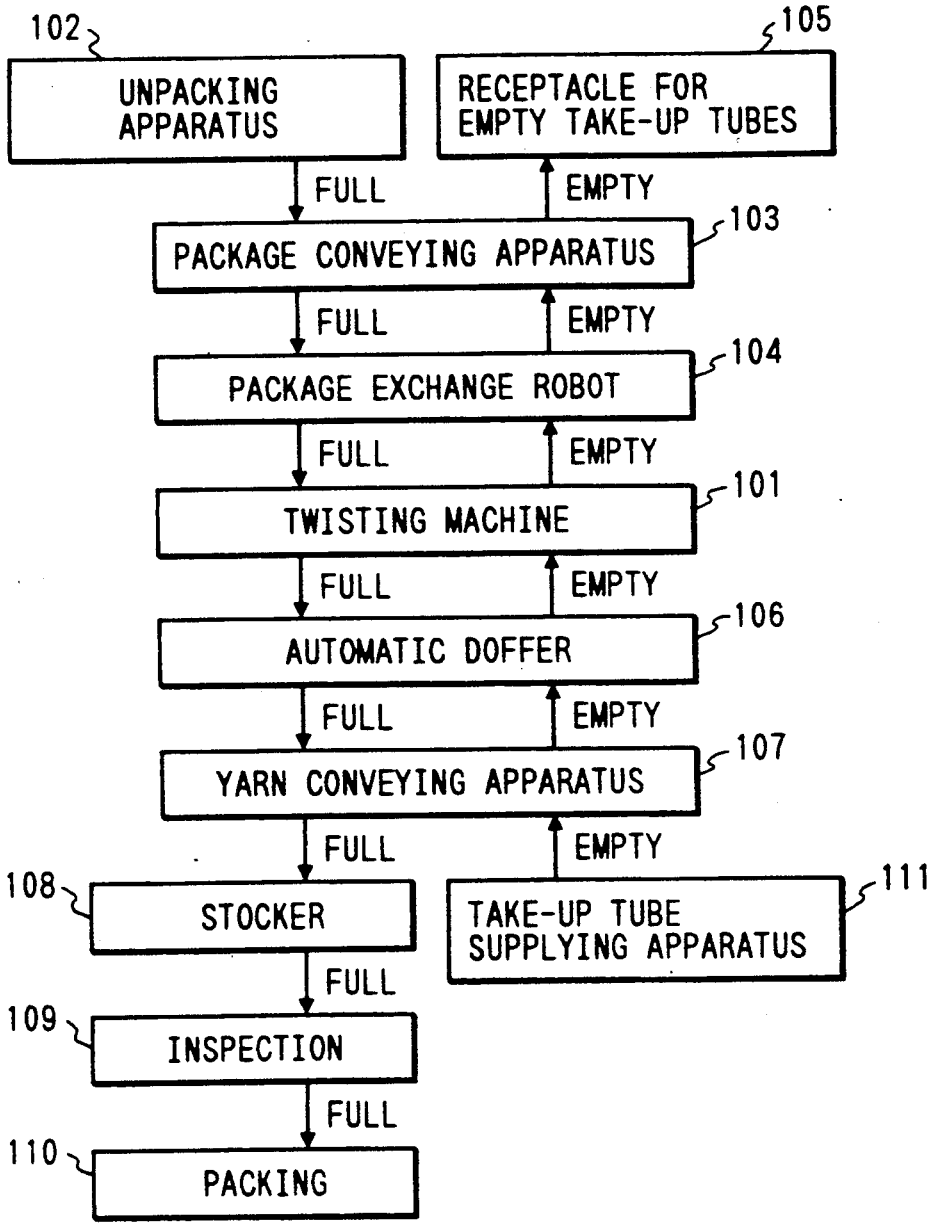
FIG. 10 is a chart showing the flow of synthetic fiber yarn in a twisting plant.
Figure 11:
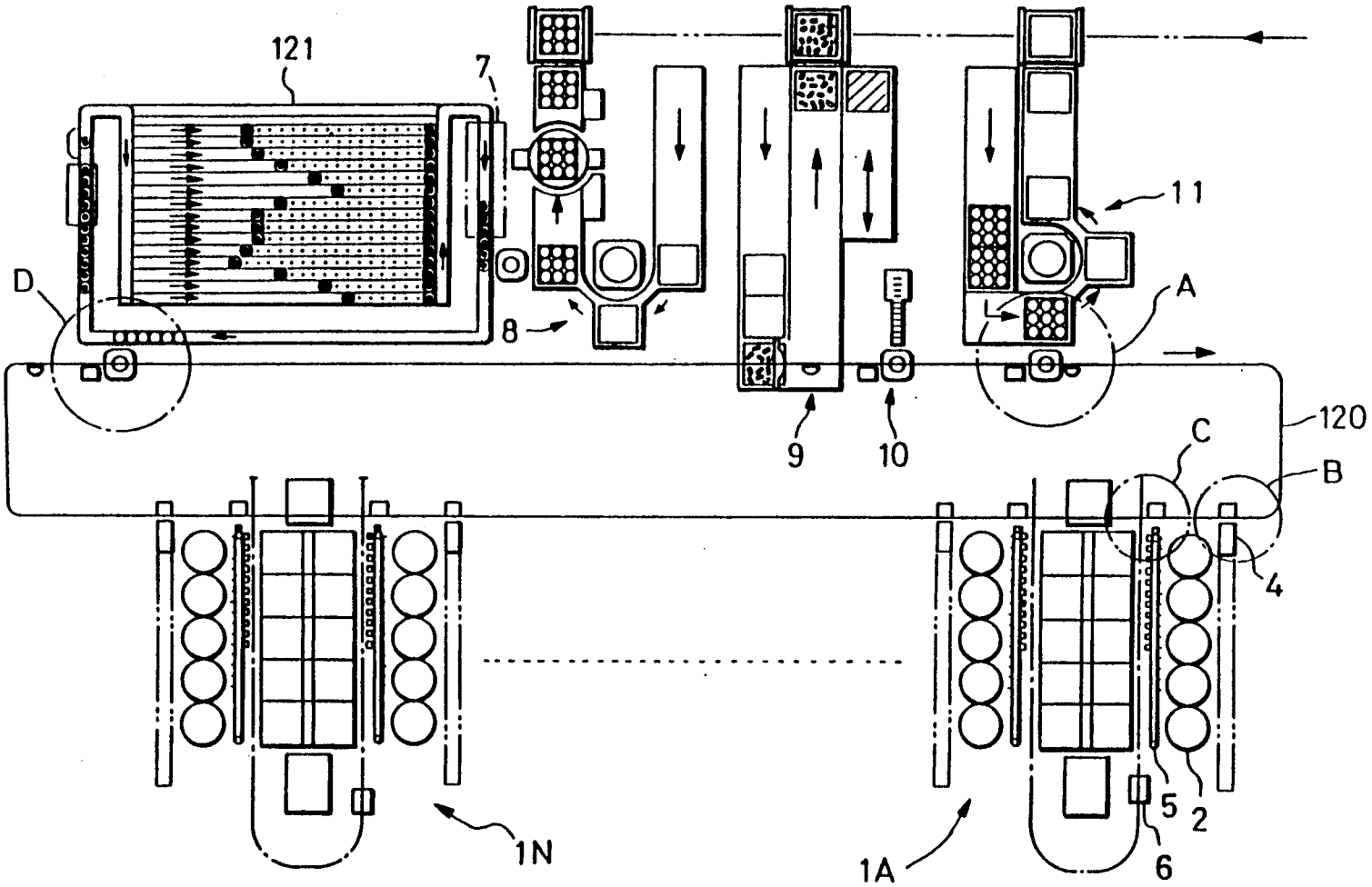
FIG. 11 PRIOR ART
FIG. 11 is a view showing the layout of the twisting plant in which an overhead conveyor is employed as the conveying apparatus.

Description will now be made with reference to FIGS. 1, 8 and 9 of a station E where packages are transferred from the rotary stocker 24 to the tray conveyor 25. FIG. 1 shows the rotary stocker 24 and the tray conveyor 25 connected to each other, and the transfer apparatus 70 positioned therebetween. The packages P of processed yarns forming a row in the rotary stocker 24 are transferred onto trays 13 one by one for successive delivery to the inspecting apparatus 7. Pushers 66 are provided in the right end of the rotary stocker 24 as shown in FIG. 8 for ejecting a package P of processed yarn from any of the peg shafts 61 arranged one above another in a row. The transfer apparatus 70 is composed mainly of a tray holder 71, a vertically movable table 72, a cylinder 73 as a driving unit and a vertical frame 74, which are shown in FIG. 8, and an empty-tray conveyor 75 and a full-tray conveyor 76, which are shown in FIG. 9. The tray holder 71 is provided with a locking device 77 for a tray 13 which can lock or unlock a projection formed on the bottom surface of the tray 13, though not shown. The tray holder 71 has a shaft 78 supported rotatably by a bearing block 79 connected to sliding rods 80. The sliding rods 80 are slidable horizontally of the drawing sheet through guides 81 fixed to the vertically movable table 72. The cylinder 73 is connected between the tray holder 71 and the vertically movable table 72, so that if its piston is advanced, the tray holder 71 may be moved forward with the sliding rods 80 and turned counterclockwise by 90° about the shaft 78 from its position shown by a solid line to its position shown by a two-dot chain line. The vertically movable table 72 is movable along the vertical frame 74 by a drive chain 82 extending along the vertical frame and connected to a motor 83. The empty-tray conveyor 75 is provided with a pusher 84 which is movable between its position shown by a solid line and its position shown by a two-dot chain line, as shown in FIG. 9. The pusher 84 is advanced to transfer an empty tray 13 onto the tray holder 71, and thereby a full tray 13 from the tray holder 71 onto the full-tray conveyor 76.

Figure 15:
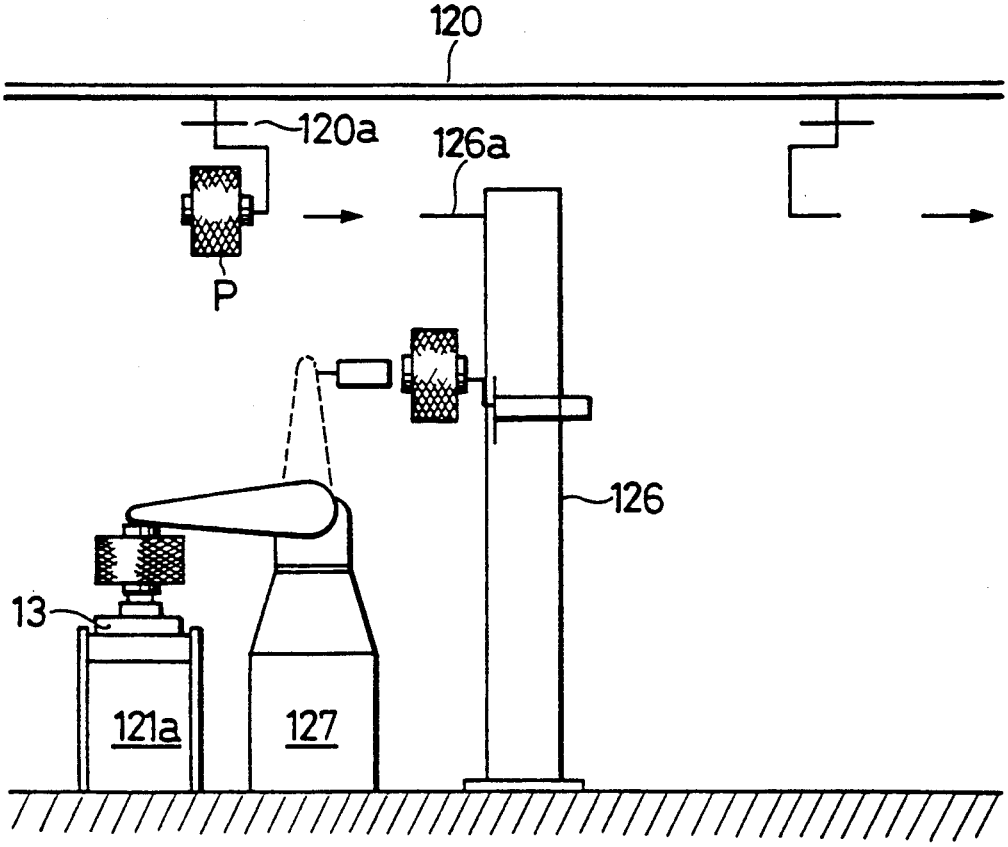
FIG. 15 PRIOR ART
FIG. 15 is a view showing the transfer of packages from the overhead conveyor to the tray stocker.

Description will be made of the transfer of packages of processed yarns to trays by the package transfer apparatus 70. An empty tray 13 is transferred onto the tray holder 71 by the pusher 84, as shown in FIG. 9. The tray 13 is fixed to the tray holder 71 by the locking device 77. The vertically movable table 72 is moved to an appropriate level of height by the motor 83 and the drive chain 82. FIG. 8 shows the table 72 in its lowermost position by way of example. The cylinder 73 as the driving apparatus is operated to advance its piston to move the tray holder 71 forward and rotate it counterclockwise by 90° to its position as shown by a two-dot chain line in which the tray 13 is aligned with the lowermost peg shaft 61 of the rotary stocker 24. The package P of processed yarn on the lowermost peg shaft 61 is pushed by the adjacent pusher 66 and thereby transferred onto the tray 13. The piston of the cylinder 73 is retracted to move back the tray holder 71 to its position shown by a solid line in which it supports the tray carrying the package thereon, or the full or loaded tray 13. If another empty tray 13 is transferred onto the tray holder 71 by the pusher 84, the full tray 13 is ejected onto the full-tray conveyor 76, as shown in FIG. 9. The foregoing sequence of operation is repeated to transfer a total of six vertically spaced apart packages P of processed yarns to trays one after another, and the rotary stocker 24 is, then, moved by a distance corresponding to the spacing between two adjoining rows of vertically spaced apart packages to enable the successive transfer of another six packages P. The package transfer apparatus 70 enables the successive transfer of a multiplicity of packages of processed yarns from the rotary stocker to the trays in a short cycle time without the aid of any separate lift as shown in FIG. 15, or any bobbin chucks for holding packages as in the robot shown in FIG. 15.

Specially, the bunch winding is formed at the top end portion of the peg shaft 61 on the rotary stocker 24. When the position of the bunch winding is desired to be located lower side on the tray 13, there is not necessary the process that the package C is clamped again and the position of the bunch winding is changed. Thus, the package P may be transferred by a few steps directing the bunch winding to a predetermined direction.

In the system of this invention for conveying packages of synthetic fiber yarn, the overhead traveling carriage including the carrier having the downwardly projecting bobbin chucks is connected between the station where it receives packages unfinished yarns from the pallets, and the station where it transfers the packages to the package exchange robot in the twisting machine, and the overhead traveling carriage including the carrier having the horizontally projecting peg shafts is connected between the station where it receives packages of processed yarns from the rotary peg in the twisting machine, and the station where it delivers the packages of processed yarns to the rotary stocker. An increase in number of the bobbin chucks, or peg shafts gives the system a larger conveying capacity. The transfer of packages of unfinished yarns to the bobbin chucks and the transfer of packages of processed yarns to the peg shafts are both performed directly. Therefore, the system has a sufficiently high conveying capacity to work with a large number of twisting machines, and is a space-saving system which enables a reduction in the number of robots and other apparatuses and in the floor space required for the installation of the stocker.

What is claimed is:

1. A system for conveying packages wherein a plurality of packages are received from a package receiving station by means of an overhead traveling carriage and the received packages are delivered to a package supply station in which packages are arranged in a different pitch from the pitch in said package receiving station, characterized in that the pitch between the packages is changed on said overhead traveling carriage.

2. A system for conveying packages including a package receiving station, a package supply station and an overhead traveling carriage traveling between the package receiving station and the package supply station, characterized in that said package receiving station is a station where a plurality of packages to be delivered to the overhead traveling carriage are arranged in a predetermined pitch, said package supply station is a station where the packages delivered form the overhead traveling carriage are arranged in different pitch from the pitch of the package in the package receiving station, and said overhead traveling carriage provides with a carrier suspended therefrom vertically and movably, and having a plurality of peg shafts, said shafts being so supported on the carrier as to be variable in pitch therebetween.

3. A system for conveying packages, comprising:

a first station configured to maintain packages in a substantially vertical orientation, a second station configured to maintain packages in a substantially vertical orientation, a first overhead traveling carriage including a first carrier having downwardly projecting bobbin chucks for transferring packages between the first station and the second station, a third station configured to maintain packages in a substantially horizontal orientation, a fourth station configured to maintain packages in a substantially horizontal orientation, and a second overhead traveling carriage including a second carrier having a plurality of substantially horizontally oriented peg shafts for transferring packages between the third station and the fourth station, a rotary stocker, and a twisting machine having a yarn exchange robot and a twisting peg, wherein the first station comprises means for delivering packages of unfinished yarn from pallets, the second station comprises means for transferring packages to the yarn exchange robot of the twisting machine, the third station comprises means for receiving packages of processed yarn from the rotary peg of the twisting machine, and the fourth station comprises means for delivering packages of processed yarn to the rotary stocker, wherein the second station comprises a swinging platform for receiving packages of unfinished yarn from the first overhead traveling carriage and for transferring packages to the yarn exchange robot, the swinging platform having a plurality of projecting peg shafts and being rotatable through an angle of approximately 90° between a position in which the peg shafts are oriented substantially vertically and a position in which the peg shafts are oriented substantially horizontally, and wherein the swinging platform comprises:

a base, a rotatable shaft, a table having a surface and being secured to the rotatable shaft, the plurality of peg shafts projecting from the surface of the table, an arm having a free end and being secured to the rotatable shaft, and a cylinder connected between the free end of the arm and the base.

4. A system for conveying packages, comprising:

a rotary stocker, a twisting machine having a yarn exchange robot and a rotary peg, a first station configured to maintain packages in a substantially vertical orientation, the first station comprising means for delivering packages of unfinished yarn from pallets, a second station configured to maintain packages in a substantially vertical orientation, the second station comprising means for transferring packages to the yarn exchange robot of the twisting machine, a first overhead traveling carriage including a first carrier having downwardly projecting bobbin chucks for transferring packages between the first station and the second station, a third station configured to maintain packages in a substantially horizontal orientation, the third station comprising means for receiving packages of processed yarn from the twisting machine, a fourth station configured to maintain packages in a substantially horizontal orientation, the fourth station comprising means for delivering packages of processed yarn to the rotary stocker, a second overhead traveling carriage including a second carrier having a plurality of substantially horizontally oriented peg shafts for transferring packages between the third station and the fourth station, a rotary peg adjacent the twisting machine, the rotary peg having a plurality of substantially horizontally oriented peg shafts, the second carrier having a plurality of horizontally oriented peg shafts that are equal in number to and alignable with the plurality of peg shafts of the rotary peg, and the second carrier being suspended from and vertically movably relative to the second overhead traveling carriage.

5. The system of claim 4, wherein the second carrier is suspended from and vertically movable relative to the second overhead traveling carriage, the second carrier comprises a plurality of horizontally oriented peg shafts, the rotary stocker comprises a plurality of movable, substantially horizontally oriented peg shafts, and the rotary stocker is configured to receive packages of processed yarn from the second overhead traveling carriage.

* * * * *